US006867740B2

(12) United States Patent
Goodyear

(10) Patent No.: US 6,867,740 B2
(45) Date of Patent: Mar. 15, 2005

(54) PORTABLE ANTENNA

(75) Inventor: Jeff Goodyear, Victoria (CA)

(73) Assignee: Human-Animal Biotelemetry Instrumentation-Technology Research Ltd., Victoria (CA)

( * ) Notice: Subject to any disclaimer, the term of this patent is extended or adjusted under 35 U.S.C. 154(b) by 0 days.

(21) Appl. No.: 10/449,839

(22) Filed: May 30, 2003

(65) Prior Publication Data

US 2004/0239573 A1 Dec. 2, 2004

(51) Int. Cl.[7] ..... H01Q 1/12
(52) U.S. Cl. ..... 343/718; 343/833; 343/834; 343/897
(58) Field of Search ..... 343/718, 833, 343/834, 872, 873, 897

(56) References Cited

U.S. PATENT DOCUMENTS

| | | | | | |
|---|---|---|---|---|---|
| 2,576,128 | A | * | 11/1951 | Lense | 343/718 |
| 4,769,656 | A | * | 9/1988 | Dickey | 343/718 |
| 5,515,067 | A | * | 5/1996 | Rits | 343/912 |
| 6,366,250 | B1 | * | 4/2002 | McConnell | 343/718 |
| 6,483,469 | B2 | * | 11/2002 | Boyle | 343/718 |
| 6,590,540 | B1 | * | 7/2003 | Adams et al. | 343/718 |
| 6,677,917 | B2 | * | 1/2004 | Van Heerden et al. | 343/897 |

* cited by examiner

*Primary Examiner*—Tan Ho
(74) *Attorney, Agent, or Firm*—Robert H. Barrigar

(57) ABSTRACT

According to this invention, there is provided a portable antenna comprising a flexible and durable conductive element fitted into an encasement made from a flexible and durable fabric-like material having a first open end wherefrom one end of the conductive element can be accessed.

9 Claims, 3 Drawing Sheets

PORTABLE ANTENNA

FIELD OF INVENTION

The invention relates generally to portable antennae, and more particularly, to wearable portable antenna.

BACKGROUND OF THE INVENTION

Portable antennae are necessary in many applications. In biotelemetry applications, where the movements of a person is tracked, that person needs to carry a portable antenna to broadcast the signal from the locator transmitter that he or she carries. Those tracking the person also need to carry portable antennae depending on the nature of the application. For example, in a search and rescue biotelemetry application where the person being tracked is lost in the wilderness, there may not be a tracking station with fixed equipment within range for receiving the signal from the locator transmitter carried by the person being tracked. As such, those who are tracking the person need to carry portable antennae with them to get within range. Furthermore, in biotelemetry applications where the person tracking wishes to stay in close proximity to the person being tracked, such as in supervised outings for patients with Alzheimer's, the tracking person needs to carry a portable antenna.

Hand-carrying a portable antenna in many circumstances may prove awkward and impractical. For example, hand-carrying an antenna during a search and rescue operation or when supervising an Alzheimer's patient in an outing will significantly reduce mobility and may prove intrusive as the tracking event will not be discrete Furthermore, in many biotelemetry applications, the frequency range used by the transmitters and receivers is in the ~100 to ~300 MHz range. This will make the minimum size of the antennae that are capable of transmitting or receiving signals in the range of ~0.75 m to ~0.25 m, which would make their manual transport difficult.

Attempts have been made to make lighter, easier-to-carry antennae for mobile applications. Two such attempts are disclosed in European Patent Application 0 274 592 A1 by Tamura, claiming priority Japanese patent applications 171032/86, 171033/86, 171034/86, 88177/87 and 88178/87, and PCT application WO 01/36728 A1 by Wilson et al. Tamura discloses a light, flexible antenna deposited on film like material, making the structure foldable into a compact size for transportation. While an antenna according to Tamura may be easy to transport, its operation will require antenna to be unfolded. As such, an antenna according to Tamura would be difficult to operate while in motion.

Wilson discloses a textile fabric ribbon into which conductive elements running the length of the ribbon are knitted, woven or braided. The ribbon, which may be releasably attached to an item of clothing, may be used as an antenna. The major disadvantage of this scheme is the difficulty of fabricating an antenna according to Wilson, namely the difficulty of knitting, weaving or braiding a conductor into a textile fabric.

What is required is a portable antenna that can be operated while the carrier of the antenna is in motion and that is simple to fabricate.

SUMMARY OF THE INVENTION

According to this invention, there is provided a portable antenna comprising a flexible and durable conductive element fitted into an encasement made from a flexible and durable fabric-like material (in this specification and the claims, "fabric-like material" means woven and knitted cloth material, and film material) having a first open end wherefore one end of the conductive element can be accessed.

The simple design of the antenna according to the invention makes it easy to fabricate. The encasement is equipped with means that enable easy attachment to articles of clothing. As such, the antenna can be easily worn by a user and carried around while it is in use for either transmitting or receiving signals. The fact that the antenna is incorporated into clothing makes it easy to carry around without affecting the mobility of the user or the user's ability to use his or her hands. Furthermore, the design of the antenna according to the invention allows it to be worn in a discrete fashion without it being intrusive to the daily routines of the user.

In some embodiments of the invention, the encasement is detachably attached to articles of clothing. In such embodiments, the user can readily transfer the antenna from one article of clothing to another. Furthermore, the user can easily switch from one antenna to another based on the frequency range used by the particular activity that the user is engaged in at a given time.

In other embodiments of the invention, the attachment may be of fixed type in order to make the attachment process faster or to make the antenna less visible or intrusive.

Different embodiments of the invention accommodate different antenna design for different applications. In one embodiment of the invention, the antenna is an omnidirectional antenna. This antenna would be suitable, for example, for users who may go on wilderness outings wearing locator transmitters. An omnidirectional antenna would transmit the locator signal in all directions, so if the user is lost his or her locator transmitter signals may be picked up by a search and rescue crew approaching him or her from any direction. In another embodiment of the invention, the antenna is a directional antenna. This antenna would be suitable, for example, for the search and rescue crew who want to know the direction of the signal that they are picking up from the locator transmitter of a lost hiker.

In one aspect, the invention is a portable directional antenna having: a driven element encasement; a feed line encasement having an open end, and being substantially perpendicularly attached to an intermediate location on the driven element encasement at an intermediate location on the feed line encasement; a feed line having a first end and a second end; a driven element, at an intermediate location on the driven element conductively attached to the feed line proximatethe first end of the feed line; the driven element being located within the driven element encasement and at least a portion of the feed line being located within the feed line encasement with the second end of the feed line accessible via the open end of the feed line encasement; a reflector element encasement substantially perpendicularly attached at an intermediate location on the reflector element encasement to the feed line encasement at a location along the length of the feed line encasement closer to the open end of the feed line encasement than the location where the driven element encasement is attached to the feed line encasement: a reflector element located within the reflector element encasement; a director element encasement substantially perpendicularly attached at an intermediate location on the director element encasement to the feed line encasement at a location along the length of the feed line encasement further from the open end of the feed line encasement than the location where the driven element encasement is attached to the feed line encasement, and a director element located within the director element encasement; wherein, the encasements are made from a flexible and durable fabric-like material; the elements are flexible, durable and conductive: and the longitudinal axis of each element is substantially parallel with the longitudinal axis of the encasement within which the element is located.

The encasements may be attached to an article of clothing. Each element may be a conductor-coated aramid-based fiber. The aramid-based fiber may be coated with a conductor selected from the group consisting of nickel, copper and silver.

The portable directional antenna may be for use with a specified frequency range having an intermediate receive frequency, wherein: the location of the attachment of the reflector element encasement to the feed line encasement is about 0.15 wavelengths of the intermediate receive frequency, along the length of the feed line encasement, from the location of the attachment of the driven element encasement to the feed line encasement; and the location of the attachment of the director element encasement to the feed line encasement is about 0.15 wavelengths of the intermediate receive frequency, along the length of the feed line encasement, from the location of the attachment of the driven element encasement to the feed line encasement.

The portable directional antenna may include at least one additional director, each additional director having: an additional director element encasement substantially perpendicularly attached at an intermediate location on the additional director element encasement to a location along the length of the feed line encasement further from the open end of the feed line encasement than the location where the driven element encasement is attached to the feed line encasement; and an additional director element located within the additional director element encasement; wherein, the additional director element encasement is made from a flexible and durable fabric-like material; the additional director element is flexible, durable and conductive; and the longitudinal axis of the additional director element is substantially parallel with the longitudinal axis of the additional director element. The portable directional antenna may be for use with a specified frequency range having an intermediate receive frequency, wherein: the location of the attachment of the reflector element encasement to the feed line encasement is about 0.15 wavelengths of the intermediate receive frequency, along the length of the feed line encasement, from the location of the attachment of the driven element encasement to the feed line encasement; the location of the attachment of the director element encasement to the feed line encasement is about 0.15 wavelengths of the intermediate receive frequency, along the length of the feed line encasement, from the location of the attachment of the driven element encasement to the feed line encasement; and the location of the attachment of the additional director element encasement to the feed line encasement is about 0.3 wavelengths of the intermediate receive frequency, along the length of the feed line encasement, from the location of the attachment of the driven element encasement to the feed line encasement.

The reflector element may be about 5% longer than the driven element: and the driven element may be about 5% longer than the director element. The driven element may be a dipole, consisting of two sections; and the feed line may comprise two distinct conductive pathways.

The advantages of the present invention will become more obvious with reference to the following drawings.

Figure 1:
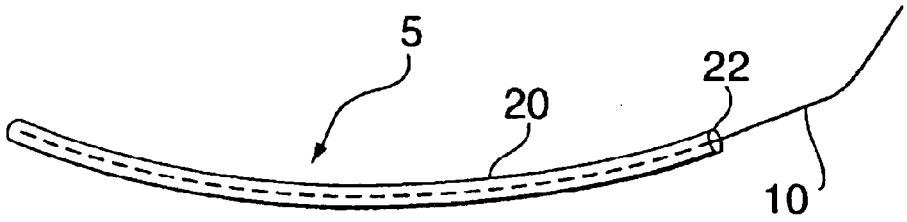
FIG. 1 is a basic embodiment of the invention.

FIG. 1 shows a basic embodiment of the invention. The antenna 5 is comprised of a conductive element 10 placed inside an encasement 20. One end 22 of the encasement 20 is open allowing access to one end 12 of the conductive element 10 for connection to a feeder line from a transmitter, receiver or other electronic component that will rely on the antenna 5 for transmission or reception of signals.

The conductive element is made of substantially conductive material while the encasement is made of dielectric material. In preferred embodiments of the antenna 5, both the conductive element 10 and the encasement 20 are made of flexible materials so they can closely adhere to the contours of clothing that the antenna 5 will be attached to and so they may be comfortably worn by a user. In preferred embodiments of the antenna 5, both the conductive element 10 and the encasement 20 are also made of durable materials. It is particularly advantageous for the conductive element 10 to be made of durable material so the normal "wear and tear" of the antenna 5 caused by a user wearing the antenna does not deteriorate the performance of the antenna. Furthermore, in embodiments of the antenna 5 wherein the antenna is fixedly attached to an item of clothing, it will be advantageous to have both the conductive element 10 and the encasement 20 made of the durable materials so the effective life of the item of clothing and the effective life of the antenna are in the same range.

As such, in preferred embodiments of the antenna 5, the encasement 20 is made of flexible, durable and washable material with a low radio frequency absorption constant, which is attachable to typical articles of clothing by gluing, stitching, heat pressing, hooks and loops, snaps or other viable attachment methods (as discussed below). Some of the material that meet these characteristics include, but are not limited to, nylon, cotton, rip-stop nylon and Mylar® and Dacron®, both by DuPont Company.

In a preferred embodiment of the antenna 5, the conductive element 10 is made of aramid-based fibers coated with conductive material. Aramids are synthetic polyamide-based fibers characterized by high durability, strength, light weight and flexibility. They are used, among other things, in flame-resistant clothing and protective vests and helmets. A number of commercial brands of aramid-based fibers are available on the market, including KEVLAR® by DuPont Company.

Aramids bond well with a number of conductive materials Such conductor-coated aramid-based fibers have the durability, flexibility, lightweight and strength characteristics of aramid-based fibers, but they also have the electrical properties required for an antenna. As such, conductor-coated aramid-based fibers are suitable for use as the conductive element 10 of the antenna 5. They have the conductive characteristics, as well they are both flexible and durable. A number of commercial brands of conductor-coated aramid-based fibers are available in the market, including ARACON® by DuPont Company. ARACON® is aramid-based fiber that is coated with nickel, copper or silver.

The encasement 20 may be attached to articles of clothing in a variety of ways. In the preferred embodiments of the invention, the method of attachment allows the antenna 5, including the conductive element 10, to remain flexible, intact, fully-functional and will not reduce the durability of the antenna 5. In some embodiments of the invention the encasement 20 is fixedly attached to articles of clothing and in another embodiment of the invention the encasement 20 is removably attached to articles of clothing. In one embodiment of the invention where the antenna will be fixedly attached to articles of clothing, the encasement 20 or portions thereof is made of or covered with a plastic-type material that, when pressed against the surface of an article of clothing and heated with an iron or a similar device, will adhere to the surface of the article of clothing. In some of the other embodiments of the invention incorporating a fixed attachment, the encasement 20 is stitched or glued to articles of clothing. In some embodiments of the invention incorporating a removable attachment, the encasement 20 is attached to articles of clothing using hooks and loops or snaps. The encasement 20 may be attached to the inner or outer surface of articles of clothing.

In FIG. 1, the encasement 20 is shown as fully enclosing the conductive element 10, except for the portion of the conductive element 10 that is beyond the end 22 of the encasement 20. It should be noted that in some embodiments of the invention there may be a gap running longitudinally along one side of the encasement 20. In these embodiments, the encasement 20 is attached to articles of clothing along this gap so the portion of the article of clothing juxtaposed against the gap completes the enclosure around the conductive element 10.

Figure 2:
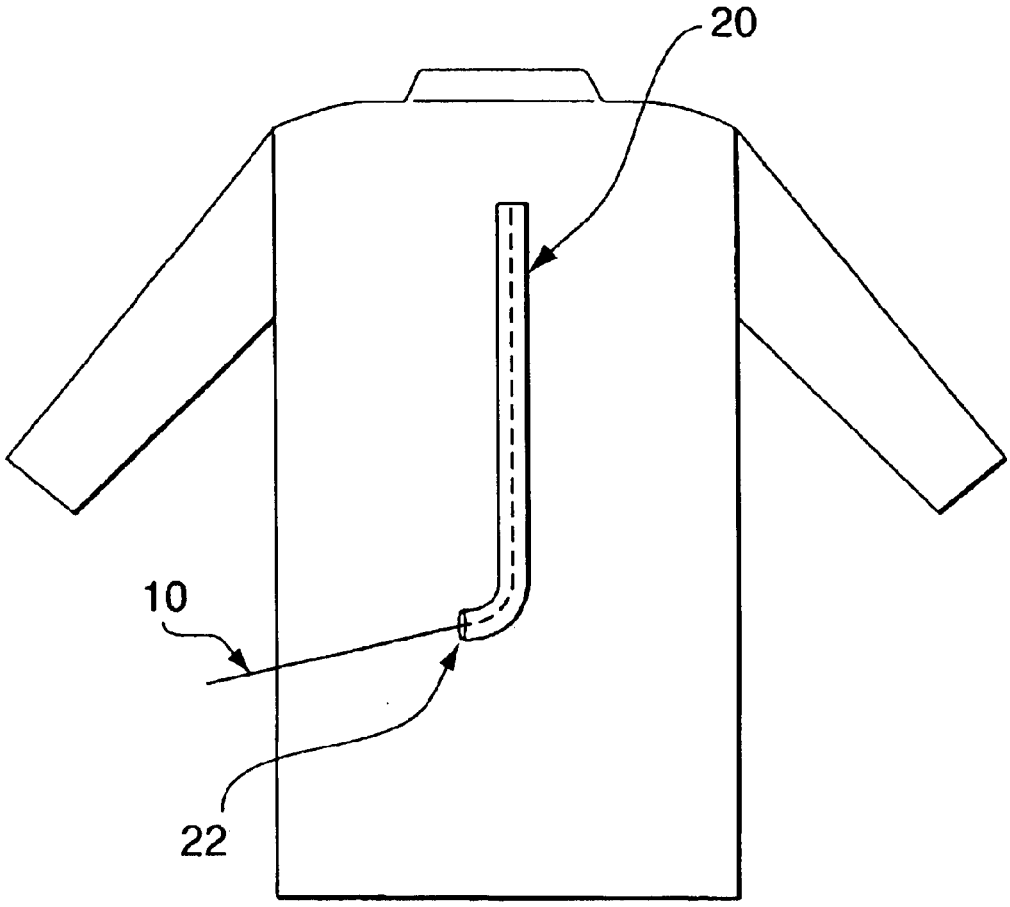
FIG. 2 is an embodiment of the invention as an omnidirectional antenna attached to back of jacket-like article of clothing.

The antennae according to the invention may have different designs based on the application for which it is to be used. In particular, they may be designed as omnidirectional or directional antennae. FIG. 2 shows an embodiment of the invention as an omnidirectional antenna attached to the back of a jacket-like article of clothing. Omnidirectional antenna 5 is shown attached to the jacket-like item of clothing substantially longitudinally along the back side of the jacket. The open end of the encasement is near the waistline of the jacket so the conductive element 10 may be conveniently coupled to a transmitter or receiver placed in the user's side-pockets or attached to his or her waist. The total length of the conductive element 10 and hence the antenna 5 will be fixed according to the frequency range for which the antenna is to be used.

Figure 3:
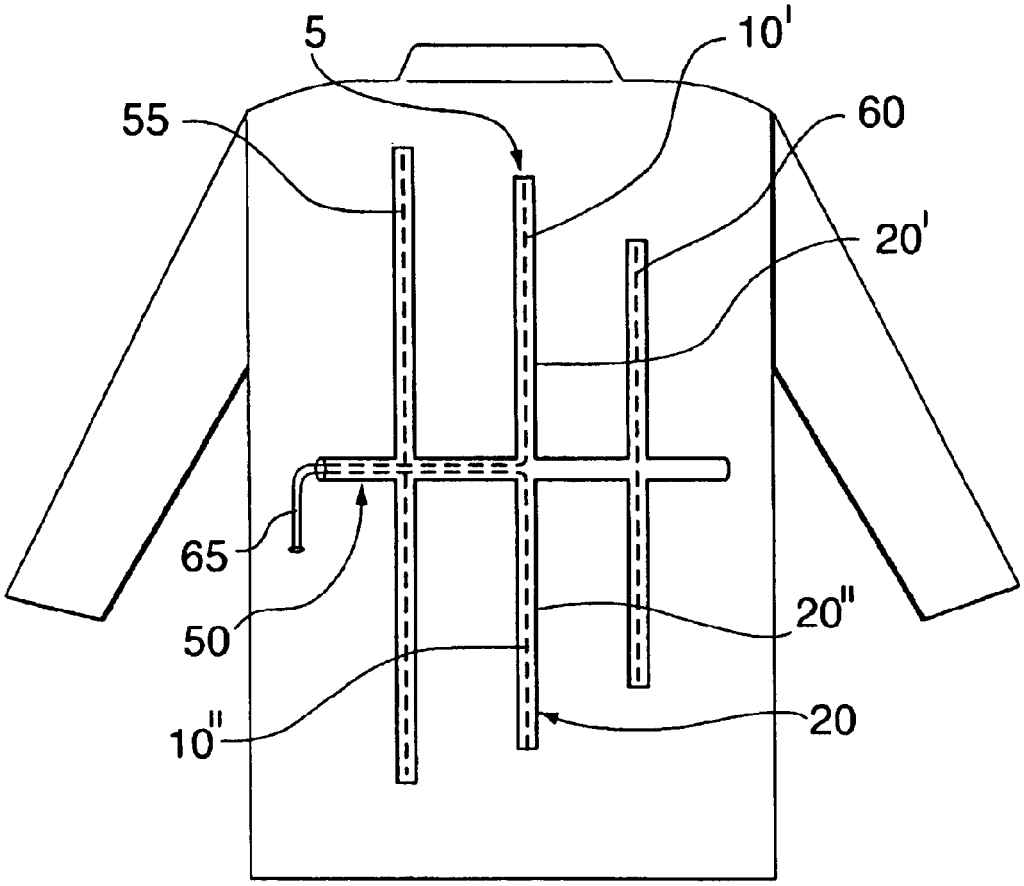
FIG. 3 is an embodiment of the invention as a directional antenna attached to back of jacket-like article of clothing

FIG. 3 shows an embodiment of the invention as a directional, or more specifically Yagi, antenna attached to the back of a jacket-like article of clothing. The directional antenna of FIG. 3 has a driven element 10, a reflector 55, a director 60 and a feeder or matched line 65. In the embodiment of the invention shown in FIG. 3, the driven element 10 is a dipole, consisting of two segments 10' and 10", made of conductive material, with each of the two segments 10', 10" of the dipole having a length so as to allow the driven element to be tuned for the frequency range in which the antenna is to operate. In a typical embodiment, the length of each segment 10'. 10" of the dipole is substantially equal to ¼ of the wavelength corresponding to the middle frequency of range in which the antenna is to operate. The driven element 10 is electrically connected to the feeder line 65, which in this preferred embodiment is a co-axial cable. In the preferred embodiment shown in FIG. 3, the physical connection between the feeder line 65 and the driven element 50 is typically perpendicular, but the angle of connection may deviate from 90 by a range of about 10.

The two segments 10', 10" of the driven element 10 are placed inside encasements 20', 20", and the feeder line 65 is placed inside encasement 70. The encasements 20', 20" are attached to encasement 70 so as to provide spatial continuity between the insides of the three encasements to allow connection between the driven element 10 and the feeder line 65. The open end of the encasement 70 is located near the waistline of the jacket so the feeder line 65 may be conveniently coupled to a transmitter or receiver placed in the user's side-pockets or attached to his or her waist.

The reflector 55 and director 60 are also made of conductive material, but they do not need to be electrically connected to the feeder line 65. The reflector 55 and director 60 are positioned on either side of the driven element 10 and are substantially parallel and co-planar with the driven element 10. The distance between the reflector 55 and the driven element 10 and the director 60 and the driven element 10 is determined according to the frequency range in which the antenna is to operate and, in a preferred embodiment, it is typically approximately 0.15 of the wavelength corresponding to the middle of the frequency range in which the antenna is to operate. The reflector 55 is slightly longer than the driven element 10, typically by about 5%, and the driven element 10 is slightly longer than director 60, also typically by about 5%. The reflector 55 and the director 60 are placed inside encasements 75, 80. Encasements 75 and 80 are attached to the encasement 70, but because there is no need for electrical connection between the feeder line 65 and each of the reflector 55 and the director 60, there is no need that the inside of each of the encasements 75, 80 and the inside of the encasement 70 be continuous.

The driven element 10, the reflector 55 and the director 60 may be made of aramid-based fibers coated with conductive material, including Aracon®.

Figure 4:
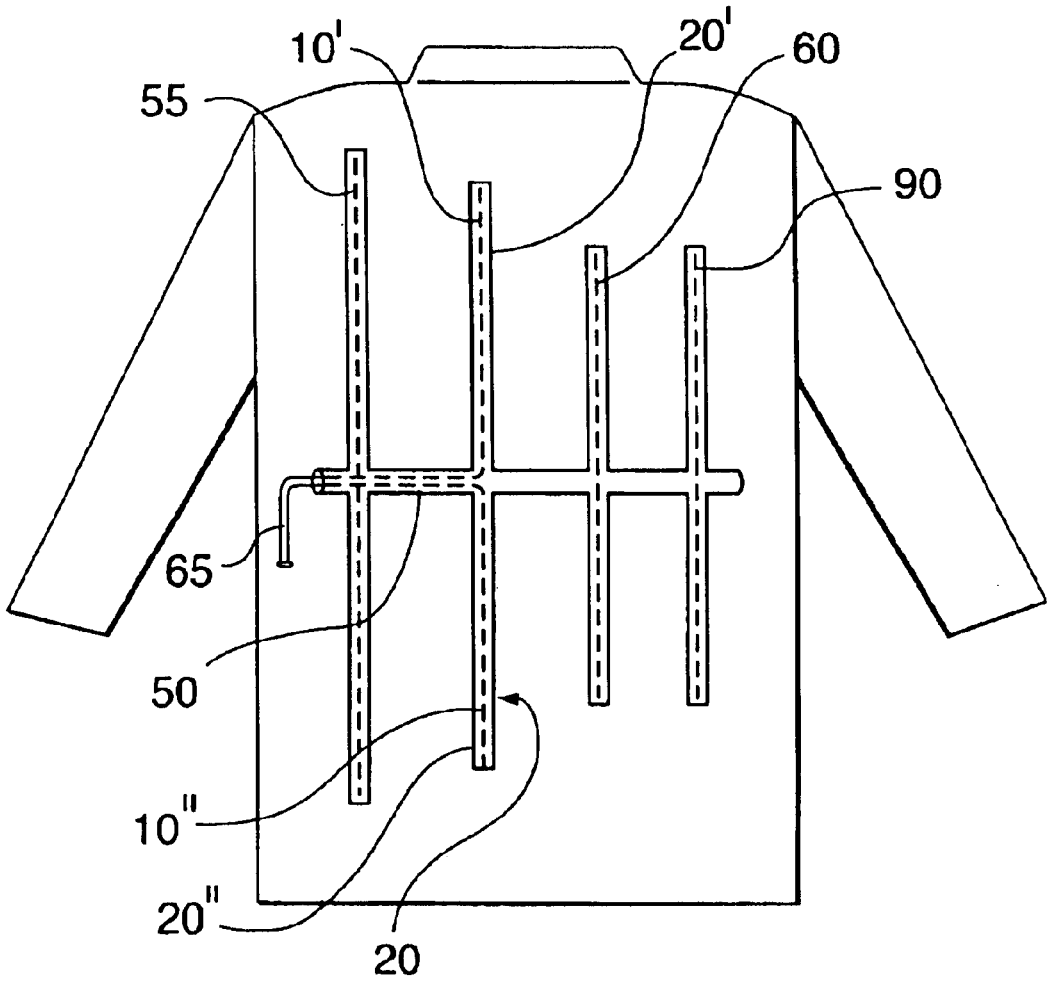
FIG. 4 is an embodiment of the invention as a directional antenna having an additional director element and shown attached to the back of a jacket-like article of clothing.

The embodiment of the invention as a directional antenna may include more than one director. An embodiment with one additional director 90 is shown in FIG. 4. In embodiments having additional directors, each additional director is substantially parallel to and co-planar with the driven element (and hence other director(s) and the reflector) and is positioned on the same side of the driven element as the first director, but farther away from the driven element. The distance between each additional director and the director next closest to the driven element is determined according to the frequency range in which the antenna is to operate, and in a preferred embodiment, it is typically approximately 0.15 of the wavelength corresponding to the middle of the frequency range in which the antenna is to operate. Additional directors are obviously practical for wearable applications only when the frequency range of the operation is sufficiently high and the respective wavelengths sufficiently short so as to allow placement of additional directors on articles of clothing such as jackets.

While the principles of the invention have now been made clear in the illustrated embodiments, it will be immediately obvious to those skilled in the art that many modifications may be made of structure, arrangements, and algorithms used in the practice of the invention, and otherwise, which are particularly adapted for specific environments and operational requirements, without departing from those principles. The claims are therefore intended to cover and embrace such modifications within the limits only of the true spirit and scope of the invention.

What is claimed is:

1. A portable directional antenna comprising:

a) a driven element encasement;

b) a feed line encasement having an open end, and being substantially perpendicularly attached to an intermediate location on the driven element encasement at an intermediate location on the feed line encasement;

c) a feed line having a first end and a second end;

d)a driven element, at an intermediate location on the driven element conductively attached to the reed line proximate the first end of the feed line;

e) the driven element being located within the driven element encasement and at least a portion of the feed line being located within the feed line encasement with the second end of the feed line accessible via the open end of the feed line encasement;

f) a reflector element encasement substantially perpendicularly attached at an intermediate location on the reflector element encasement to the feed line encasement at a location along the length of the feed line encasement closer to the open end of the feed line encasement than the location where the driven element encasement is attached to the feed line encasement;

g) a reflector element located within the reflector element encasement;

h) a director element encasement substantially perpendicularly attached at an intermediate location on the director element encasement to the feed line encasement at a location along the length of the feed line encasement further from the open end of the feed line encasement than the location where the driven element encasement is attached to the feed line encasement, and i) a director element located within the director element encasement;

wherein, the encasements are made from a flexible and durable fabric-like material; the elements are flexible, durable and conductive; and the longitudinal axis of each element is substantially parallel with the longitudinal axis of the encasement within which the element is located.

2. The portable directional antenna of claim 1, wherein the encasements are attached to an article of clothing.

3. The portable directional antenna of claim 1, wherein each element comprises a conductor-coated aramid-based fiber.

4. The portable directional antenna of claim 3, wherein the aramid-based fiber is coated with a conductor selected from the group consisting of nickel, copper and silver.

5. The portable directional antenna of claim 1, wherein the portable directional antenna is for use with a specified frequency range having an intermediate receive frequency, wherein:

a) the location of the attachment of the reflector element encasement to the feed line encasement is about 0.15 wavelengths of the intermediate receive frequency, along the length of the feed line encasement, from the location of the attachment of the driven element encasement to the feed line encasement; and b) the location of the attachment of the director element encasement to the feed line encasement is about 0.15 wavelengths of the intermediate receive frequency, along the length of the feed line encasement, from the location of the attachment of the driven element encasement to the feed line encasement.

6. The portable directional antenna of claim 1, further comprising at least one additional director, each additional director comprising:

a) an additional director element encasement substantially perpendicularly attached at an intermediate location on the additional director element encasement to a location along the length of the feed line encasement further from the open end of the feed line encasement than the location where the driven element encasement is attached to the feed line encasement; and b) an additional director element located within the additional director element encasement;

wherein, the additional director element encasement is made from a flexible and durable fabric-like material: the additional director element is flexible, durable and conductive; and the longitudinal axis of the additional director element is substantially parallel with the longitudinal axis of the additional director element.

7. The portable directional antenna of claim 6, wherein the portable directional antenna is for use with a specified frequency range having an intermediate receive frequency, wherein:

a) the location of the attachment of the reflector element encasement to the feed line encasement is about 0.15 wavelengths of the intermediate receive frequency, along the length of the feed line encasement, from the location of the attachment of the driven element encasement to the feed line encasement;

b) the location of the attachment of the director element encasement to the feed line encasement is about 0.15 wavelengths of the intermediate receive frequency, along the length of the feed line encasement, from the location of the attachment of the driven element encasement to the feed line encasement; and c) the location of the attachment of the additional director element encasement to the feed line encasement is about 0.3 wavelengths of the intermediate receive frequency, along the length of the feed line encasement, from the location of the attachment of the driven element encasement to the feed line encasement.

8. The portable directional antenna of claim 1, wherein:

a) the reflector element is about 5% longer than the driven element; and b) the driven element is about 5% longer than the director element.

9. The portable directional antenna of claim 1, wherein:

a) the driven element is a dipole, consisting of two sections; and b) the feed line comprises two distinct conductive pathways.

* * * * *